US011867416B2

(12) United States Patent
Pourgol-Mohammad et al.

(10) Patent No.: US 11,867,416 B2
(45) Date of Patent: Jan. 9, 2024

(54) REMAINING USEFUL LIFE ESTIMATOR OF COMPONENTS OF HVAC SYSTEM

(71) Applicant: Johnson Controls Technology Company, Auburn Hills, MI (US)

(72) Inventors: Mohammad Pourgol-Mohammad, Westwood, MA (US); Karl B. Washburn, Oklahoma City, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 849 days.

(21) Appl. No.: 16/683,042

(22) Filed: Nov. 13, 2019

(65) Prior Publication Data

US 2021/0140663 A1 May 13, 2021

(51) Int. Cl.

| | |
|---|---|
| ***F24F 11/38*** | (2018.01) |
| ***F24F 11/52*** | (2018.01) |
| ***F24F 11/63*** | (2018.01) |

(52) U.S. Cl.

CPC ..... *F24F 11/38* (2018.01); *F24F 11/52* (2018.01); *F24F 11/63* (2018.01)

(58) Field of Classification Search

CPC .. F24F 11/38; F24F 11/52; F24F 11/30; F24F 1/34; F24F 11/62; F24F 1/63; G06N 20/00; F04D 29/668; G02B 27/0172

See application file for complete search history.

(56) References Cited

U.S. PATENT DOCUMENTS

| | | | | |
|---|---|---|---|---|
| 5,381,950 | A * | 1/1995 | Aldridge | G05D 23/1902 337/380 |
| 7,168,324 | B2 | 1/2007 | Boda et al. | |
| 7,322,794 | B2 | 1/2008 | LeMieux et al. | |
| 3,050,874 | A1 | 11/2011 | Papadimitriou et al. | |
| 9,229,438 | B2 | 1/2016 | Fulghum et al. | |
| 9,933,295 | B2 | 4/2018 | Fish et al. | |
| 10,031,535 | B2 | 7/2018 | Rollins et al. | |
| 10,083,255 | B2 | 9/2018 | Majewski et al. | |
| 10,139,124 | B2 | 11/2018 | Berg et al. | |

(Continued)

FOREIGN PATENT DOCUMENTS

| | | | | |
|---|---|---|---|---|
| CN | 209085657 | * | 7/2019 | |
| EP | 3206103 | A1 * | 8/2017 | G05B 23/0256 |
| WO | WO-2010107881 | A1 * | 9/2010 | B01J 19/1825 |

OTHER PUBLICATIONS

Yazdanipour et al., "Stochastic Fatigue Crack Growth Analysis of Metallic Structures under Multiple Thermal—Mechanical Stress Levels", Journal of Materials and Design, Oct. 8, 2015 (13 pages).

(Continued)

*Primary Examiner* — Michael J Dalbo
*Assistant Examiner* — Kaleria Knox
(74) *Attorney, Agent, or Firm* — Fletcher Yoder, P.C.

(57) ABSTRACT

A heating, ventilation, and/or air conditioning (HVAC) system with a vibration sensor coupled to a component of the HVAC system includes a data analyzer with a processor configured to receive an input from the vibration sensor coupled to the component of the HVAC system. The processor is configured to determine a remaining useful life (RUL) indication for the component of the HVAC system based on applying an analytical model using the input from the vibration sensor and to output the RUL indication.

23 Claims, 8 Drawing Sheets

(56) References Cited

U.S. PATENT DOCUMENTS

2004/0080155 A1* 4/2004 Hayes ..... F16L 41/086 285/124.2
2005/0236013 A1* 10/2005 Huston ..... B63J 2/04 134/1
2006/0185382 A1* 8/2006 Kim ..... F24F 13/20 62/331
2007/0225849 A1* 9/2007 Norbeck ..... F24F 11/30 700/107
2010/0169030 A1* 7/2010 Parlos ..... F04D 15/0088 702/58
2012/0100011 A1* 4/2012 Sommer ..... F04D 27/0246 417/44.1
2014/0039806 A1* 2/2014 Liao ..... G06N 3/126 702/34
2014/0262134 A1* 9/2014 Arensmeier ..... F24D 5/12 165/11.2
2015/0300683 A1* 10/2015 Boecker ..... F24F 1/34 62/296
2016/0215996 A1* 7/2016 Blair ..... F24F 11/58
2018/0032969 A1* 2/2018 Gillette ..... F24F 11/52
2018/0328611 A1* 11/2018 Bullock ..... G01M 99/008
2018/0347843 A1* 12/2018 Friedenberger ..... F24F 11/62
2019/0123931 A1* 4/2019 Schuster ..... G06N 20/00
2019/0145646 A1* 5/2019 Hamilton ..... F24F 11/58 702/183
2019/0293077 A1* 9/2019 Brendel ..... F04D 29/668
2019/0392088 A1* 12/2019 Duff ..... G02B 27/0172

OTHER PUBLICATIONS

Shiri et al., "A Fatigue Damage Accumulation Model Based on Stiffness Degradation of Composite Materials", Journal of Materials and Design, Jul. 1, 2015 (6 pages).
Shiri et al., "Prediction of Remaining Fatigue Cycles in Composite Materials under Uncertainty", ASME-ASCE Journal of Risk and Uncertainty in Engineering Systems: Part B: Mechanical Engineering, Mar. 5, 2015 (6 pages).
Yazdanipour et al., "Fatigue Life Prediction Based on Probabilistic Fracture Mechanics: Case Study of Automotive Parts", ASME-ASCE Journal of Risk and Uncertainty in Engineering Systems: Part B: Mechanical Engineering, Feb. 18, 2015 (6 pages).
Salehpour-Oskouei et al., "Sensor Placement Determination in System Health Monitoring Process Based on Dual Information Risk and Uncertainty Criteria", Proceedings of IMechE Part O: Journal of Risk and Reliability, Jan. 15, 2017 (17 pages).
Salimi et al., "Stochastic Fatigue Crack Growth Analysis for Space System Reliability", ASME-ASCE Journal of Risk and Uncertainty in Engineering Systems: Part B: Mechanical Engineering, Feb. 15, 2017 (7 pages).

* cited by examiner

REMAINING USEFUL LIFE ESTIMATOR OF COMPONENTS OF HVAC SYSTEM

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a building, home, or other structure. Over time, the HVAC system, or portions thereof, may be exposed to certain ambient conditions, such as fluctuating temperatures, humidities, and pressures. Additionally, during operation, the HVAC system may experience mechanical stresses due to vibrations and/or relative movement of certain components within the HVAC system. In some instances, the exposure to the ambient conditions and/or the mechanical stresses may facilitate/accelerate degradation of the components of the HVAC system. For example, certain levels of vibrations at or within the components of the HVAC system may accelerate the degradation of the components of the HVAC system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system with a vibration sensor coupled to a component of the HVAC system includes a data analyzer with a processor configured to receive an input from the vibration sensor coupled to the component of the HVAC system. The processor is configured to determine a remaining useful life (RUL) indication for the component of the HVAC system based on applying an analytical model using the input from the vibration sensor and to output the RUL indication.

In another embodiment, a non-transitory computer readable storage medium for a heating, ventilation, and/or air conditioning (HVAC) system includes instructions that, when executed by a processor, cause the processor to receive an input from a vibration sensor coupled to a component of the HVAC system, determine a remaining useful life (RUL) indication for the component of the HVAC system based on applying an analytical model using the input from the vibration sensor, and output the RUL indication.

In yet another embodiment, a heating, ventilation, and/or air conditioning (HVAC) system includes a first vibration sensor coupled to a first component of the HVAC system, a second vibration sensor coupled to a second component of the HVAC system, and a data analyzer. The data analyzer includes a processor configured to receive a first input from the first vibration sensor coupled to the first component of the HVAC system, determine a first remaining useful life (RUL) indication for the first component of the HVAC system based on applying a first analytical model using the first input from the first vibration sensor, receive a second input from the second vibration sensor coupled to the second component of the HVAC system, and determine a second RUL indication for the second component of the HVAC system based on applying a second analytical model using the second input from the second vibration sensor. The processor is also configured to determine potential fault mechanism interactions of the first component and the second component based on data indicative of the first component and of the second component and determine an overall RUL indication for the HVAC system based on the first RUL indication, the second RUL indication, and the potential fault mechanism interactions of the first component and the second component.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
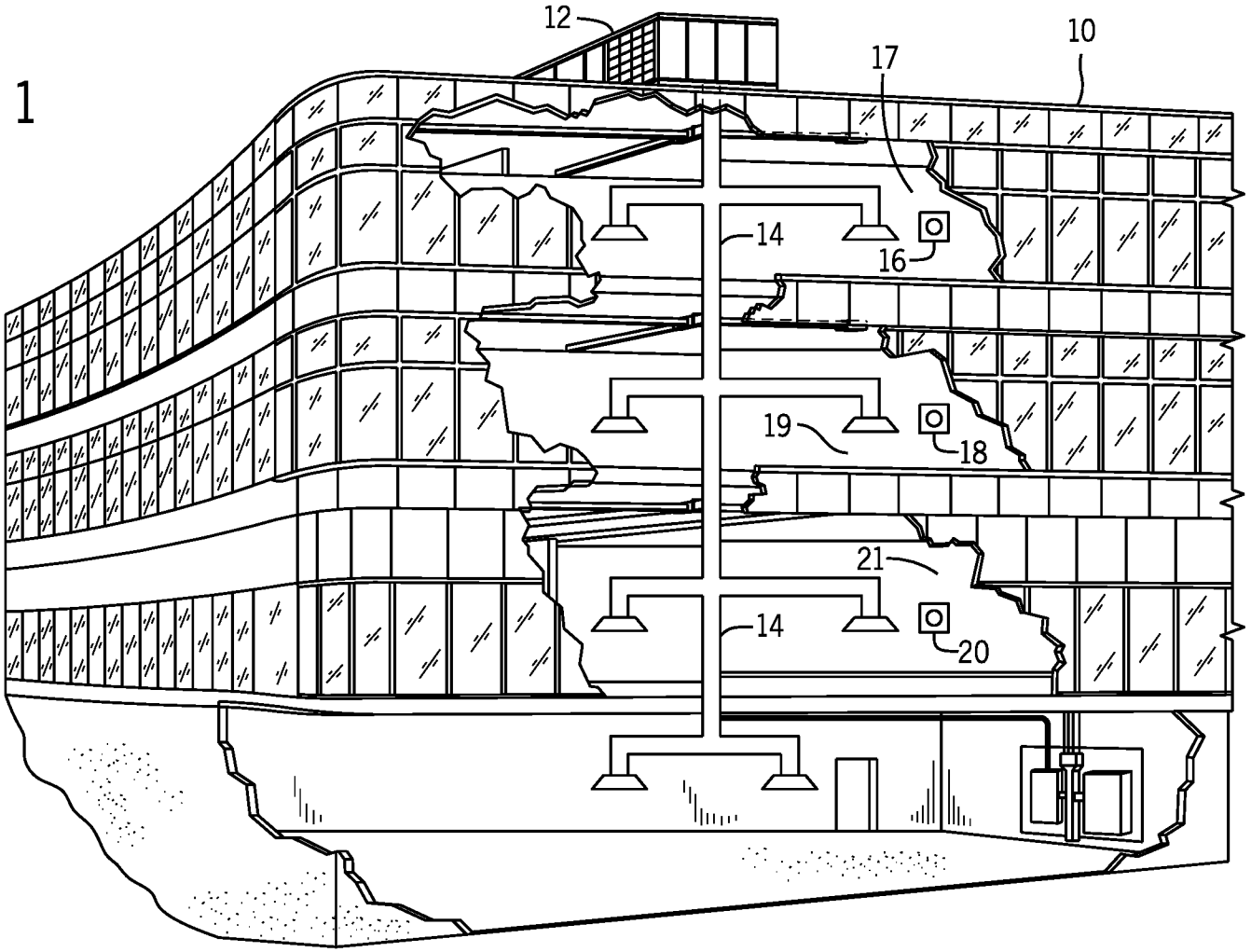
FIG. 1 is a perspective view of an embodiment of a heating, ventilation, and/or air conditioning (HVAC) system for building environmental management that may employ one or more HVAC units, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, a heating, ventilation, and/or air conditioning (HVAC) system may be used to thermally regulate an environment, such as a building, home, or other structure. The HVAC system generally includes components that direct and/or accelerate air flow into, through, and out of the HVAC system, components that mount/secure other components within the HVAC system, components that facilitate fluid flow through the HVAC system, components that facilitate heat exchange between fluid and air within the HVAC system, and other components configured to facilitate thermal regulation of an environment. Over time, the components of the HVAC may be exposed to certain ambient conditions, such as fluctuating temperature, humidity, pressure, air flow rate, and air quality. Additionally, during operation, the components of the HVAC system may experience mechanical stresses due to movement relative to other components. For example, the relative movement may include vibrations induced within one or more components of the HVAC system. In some instances, the exposure of the components to the ambient conditions and/or the mechanical stresses may facilitate/accelerate degradation and/or fatigue of the components. Such degradation and/or fatigue of the components may cause certain fault mechanisms of the components, such as wear, cracks, fractures, leaks, and/or noise.

Accordingly, the present disclosure provides systems and methods for determining a remaining useful life (RUL) of the components of the HVAC system, and/or of the HVAC system generally, based on the exposure of the components to the ambient conditions and the mechanical stresses. For example, a data analyzer of the HVAC system may determine the RUL of a component of the HVAC system based on a received parameter of the HVAC system, such as an ambient condition and/or a material characteristic of the component, and based on received input from a vibration sensor coupled to the component of the HVAC system. More specifically, the data analyzer may select a particular RUL analytical model from a plurality of RUL analytical models based on the received parameter. Using the selected RUL analytical model, the data analyzer may determine the RUL for the component based on the input from the vibration sensor. In certain embodiments, the data analyzer may be an RUL estimator. As discussed in detail below, the determination of the RUL for components of the HVAC system, and/or for the HVAC system generally, may enable efficient operation of the HVAC system and/or communication of the RUL to a technician, operator, service provider, owner, and other personnel. For example, based on the RUL, a control system of the HVAC system may de-rate the HVAC system, shut down a portion of the HVAC system, or shut down the entire HVAC system. Additionally or alternatively, after communicating the RUL to the personnel, the personnel may manage the HVAC system, such as by shutting down the HVAC system and/or by replacing the component of the HVAC system after a given time period or before a time period associated with the RUL expires. As such, the systems and methods described herein improve/facilitate operation and management of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may operate in multiple zones of the building and may be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
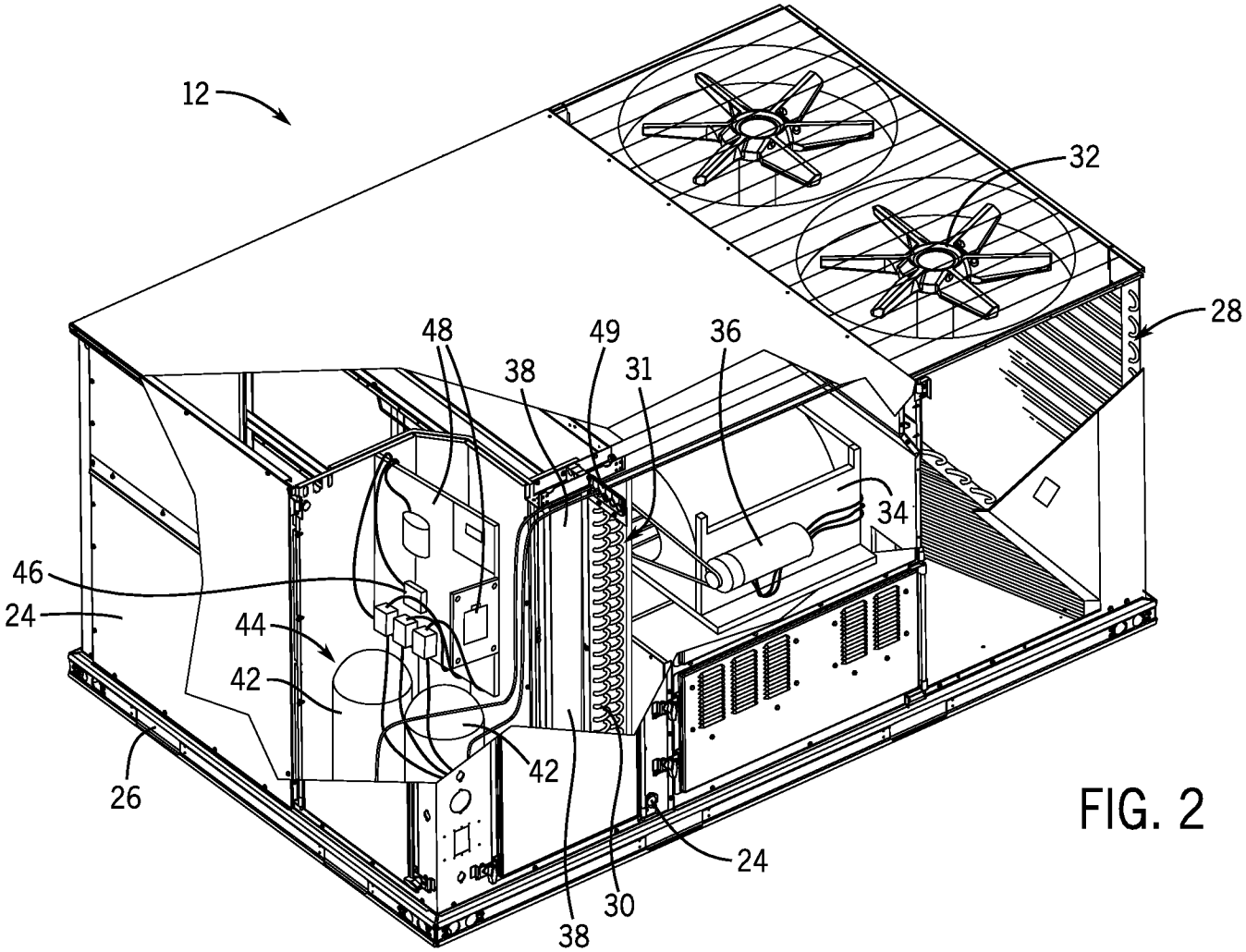
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 or enclosure encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board or controller 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
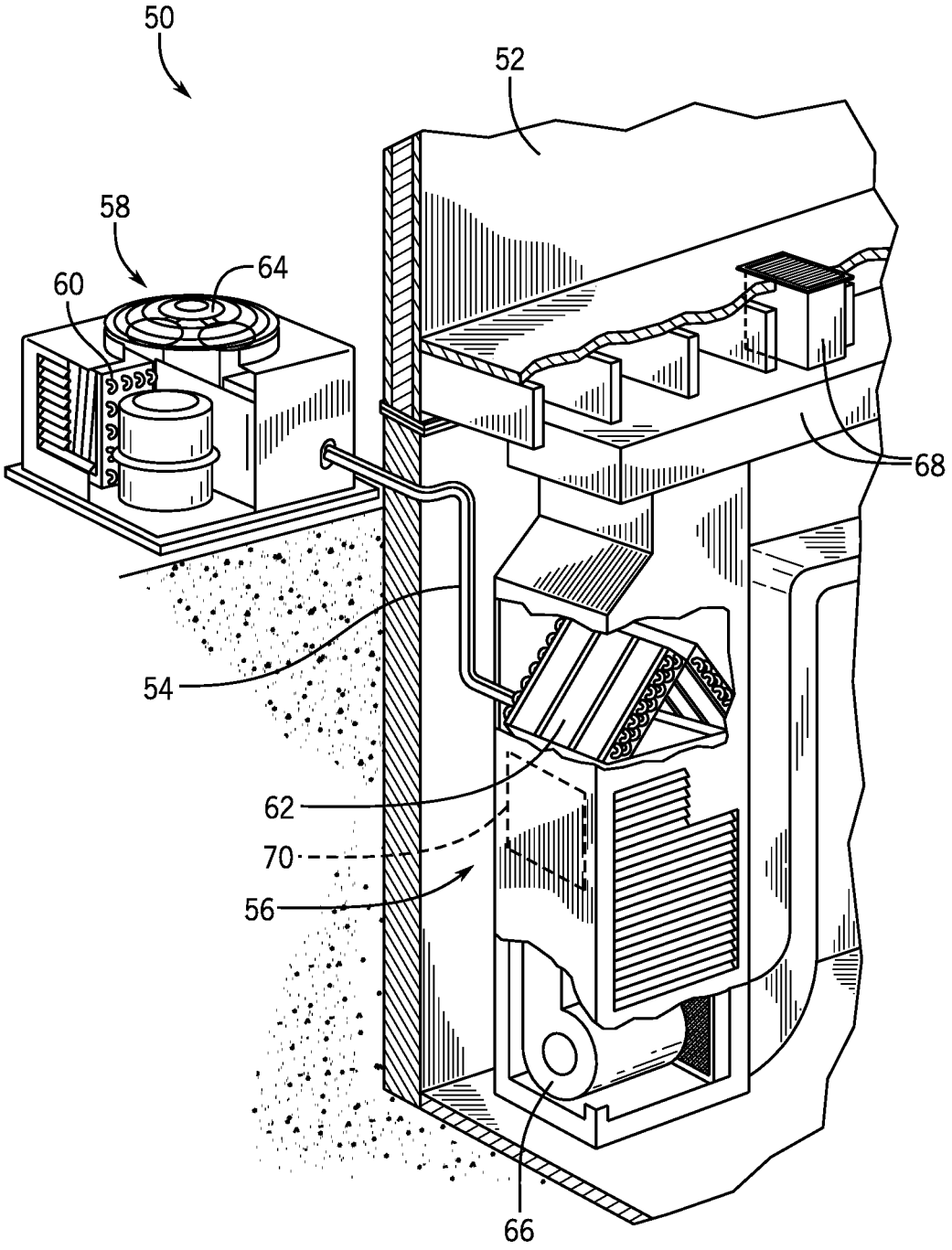
FIG. 3 is a perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
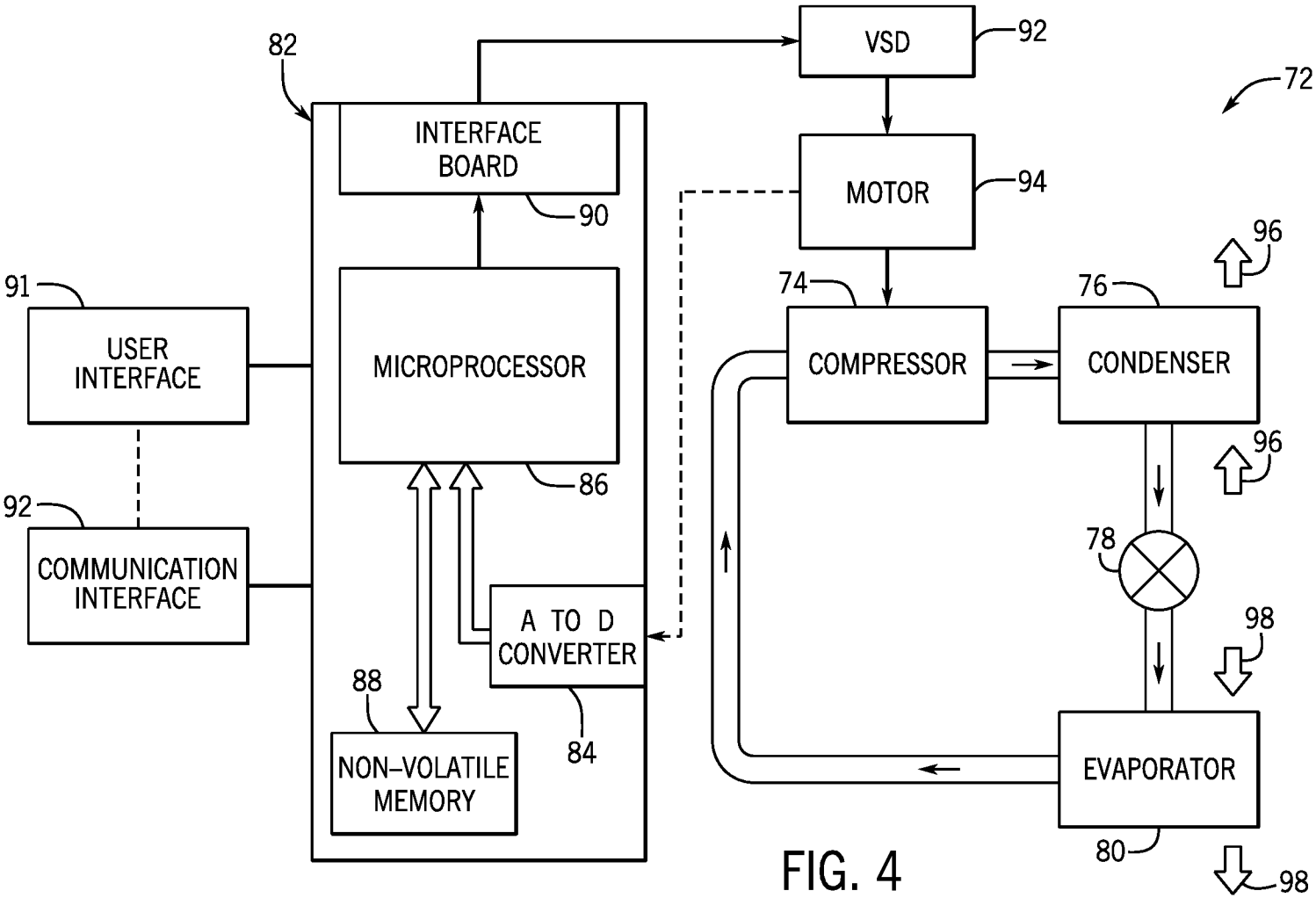
FIG. 4 is a schematic of an embodiment of a vapor compression system that may be used in an HVAC system, in accordance with an aspect of the present disclosure.

FIG. 4 is an embodiment of a vapor compression system 72 that may be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that may be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may be incorporated with any or all of the features described above, as well as other systems not described above. In particular, as will be discussed in more detail below, the present disclosure provides techniques that enable determining RUL for components of an HVAC system and/or for the HVAC system generally. For example, the RUL may be determined for a component of the HVAC system via an RUL analytical model that is selected from a plurality of RUL analytical models based on ambient condition(s) at the component. The selected RUL analytical model may calculate the RUL using vibration data, which may be collected from a sensor disposed on or near the component.

Figure 5:
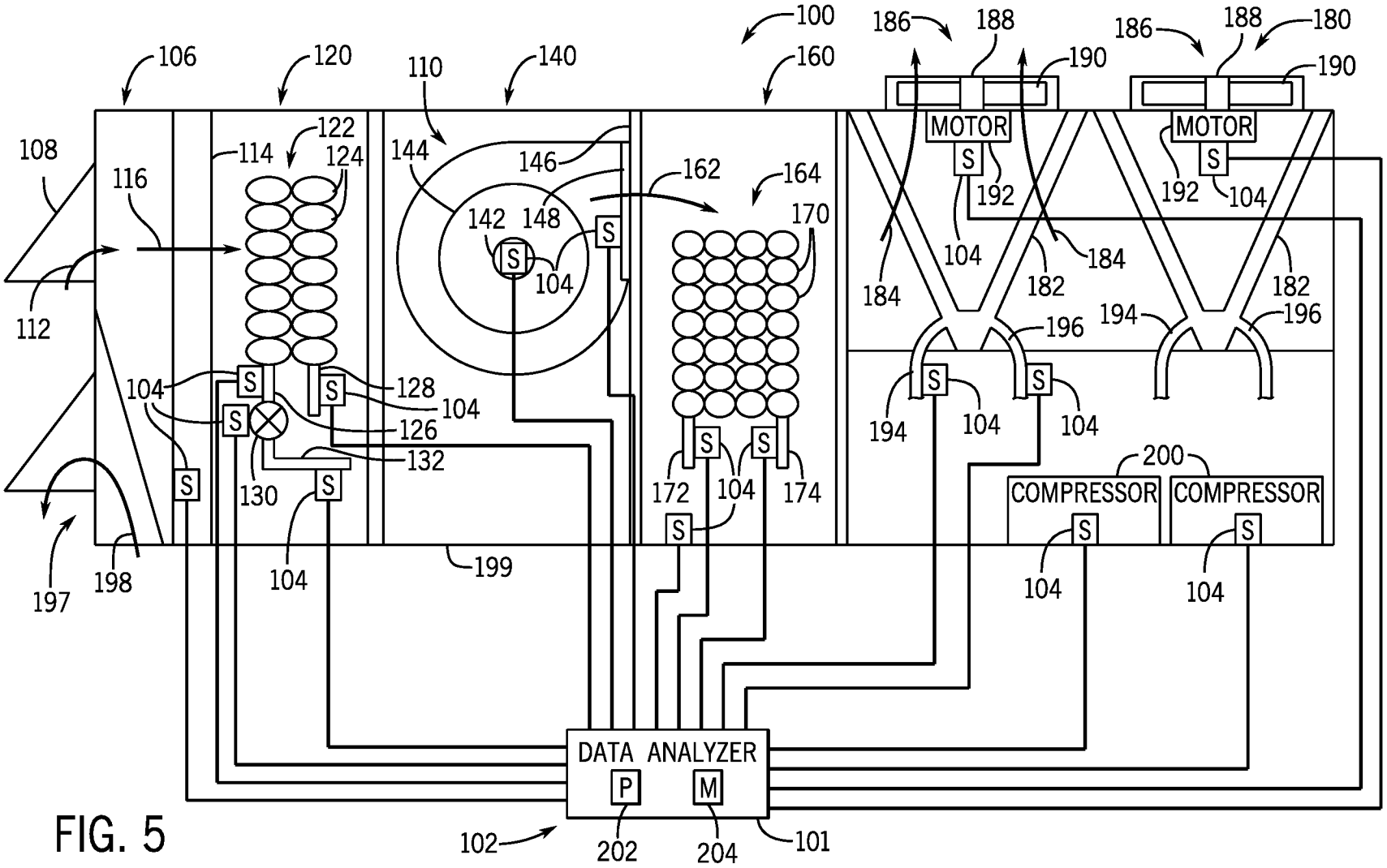
FIG. 5 is a schematic of an embodiment of an HVAC unit, in accordance with an aspect of the present disclosure.

To help illustrate, FIG. 5 is a schematic of an HVAC system 100 having a data analyzer 101 configured to determine an RUL of components of the HVAC system 100 and/or of the HVAC system 100 generally. The data analyzer 101 may be included in a control system 102 of the HVAC system 100. The illustrated HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system. As described in greater detail below, certain components of the HVAC system 100 may be exposed to certain and/or fluctuating ambient conditions, such as ambient temperature, ambient humidity, ambient pressure, ambient air flow rate, and ambient air quality. The HVAC system 100 and its components may also experience vibrations during operation of the HVAC system 100. As such, the HVAC system 100 includes the control system 102 that may determine, via the data analyzer 101, the RUL of components of the HVAC system 100, and/or of the HVAC system 100 generally, based on the ambient conditions and/or the vibrations experienced by the components.

For example, the control system 102 may receive sensor data/input from sensors 104 disposed throughout the HVAC system 100 that are coupled to components of the HVAC system 100. In certain embodiments, the control system 102 may include the sensors 104. The sensors 104 may include ambient condition sensors that sense/measure ambient conditions near the components, such as temperature, humidity, pressure, air flow rate, air quality, and the like, and/or may include vibration sensors that sense/measure vibrations of the components, such as via stress, strain, displacement, and/or acceleration of the components. The ambient conditions may generally include ambient conditions within the HVAC system 100 and/or adjacent to the HVAC system 100. The control system 102, via the data analyzer 101, may determine the RUL for components of the HVAC system 100 based on the received sensor data and based on one of a variety of RUL analytical models. In certain embodiments, the control system 102 may select a particular RUL analytical model from a plurality of available RUL analytical models based on a received parameter, such as a type of the ambient condition detected by the sensors 104. The control system 102 may determine the RUL of the component by applying the particular RUL analytical model using the sensed vibration data.

With this in mind, the HVAC system 100 may include an intake section 106 having an intake hood 108. As described in greater detail below, a blower 110 of the HVAC system 100 may draw air into the intake section 106 through the intake hood 108, as indicated by arrow 112. For example, the HVAC system 100 may be positioned outdoors, and the intake section 106 may receive unfiltered, outdoor air for conditioning by the HVAC system 100. In other embodiments, the HVAC system 100 may be positioned indoors, and the intake section 106 may receive indoor air. After passing through the intake section 106, air may flow through an air filter 114, as indicated by arrow 116. The air filter 114 may be any filter suitable for filtering air, such as a filter configured to remove dust, dirt, debris, smoke, and other particles from air. Sensors 104 may be disposed at and/or within filter driers of the air filter 114 and may sense ambient conditions and vibrations at the filter driers and/or at the air filter 114. The sensed ambient condition and vibration data may be communicated to and received by the control system 102.

After passing through the air filter 114, the filtered air may enter an evaporator section 120 of the HVAC system 100. The evaporator section 120 may include an evaporator 122 that cools air via refrigerant. For example, refrigerant may flow through coiled tubing 124 of the evaporator 122, air may pass over the coiled tubing 124, and the refrigerant may absorb heat from the air, thereby cooling the air as the air passes through the evaporator section 120. The evaporator 122 may include an inlet conduit 126 coupled to the coiled tubing 124 that supplies refrigerant into the coiled tubing 124. Additionally, the evaporator 122 may include an outlet conduit 128 coupled to the coiled tubing 124 that receives refrigerant from the coiled tubing 124, such as after the refrigerant absorbs heat from the air. Additionally, the HVAC system 100 may include an expansion device 130 disposed along and/or adjacent to the inlet conduit 126, where refrigerant expands to become a low pressure and temperature liquid. The expansion device 130 may be a thermal expansion valve (TXV); however, according to other embodiments, the expansion device 130 may be an electromechanical valve, an orifice, or a capillary tube, among others.

An additional section of tubing 132 of the HVAC system 100 may extend from the inlet conduit 126 and/or the expansion device 130. The tubing 132 may provide refrigerant to the inlet conduit 126 and/or the expansion device 130. The tubing 132 may be an unsupported length of tubing within the HVAC system 100. For example, the tubing 132 may be freestanding within the HVAC system 100. The outlet conduit 128 and the tubing 132 may be coupled to other refrigerant tubing and/or to other devices/components within the HVAC system 100 and may direct the refrigerant to and/or from the other refrigerant tubing and/or the other devices/components. The coiled tubing 124, the inlet conduit 126, the outlet conduit 128, and/or the tubing 132 may be any suitable refrigerant tubing, such as tubing including copper and/or aluminum. Air may exit the evaporator section 120 and flow into a building connected to the HVAC system 100 or other suitable conditioned space, thereby cooling the building or other suitable conditioned space.

The evaporator section 120 may include sensors 104 disposed at and/or coupled to certain components, such as the inlet conduit 126, the outlet conduit 128, the expansion device 130, and the tubing 132. The sensors 104 may sense ambient conditions and vibrations at certain components, such as inlet conduit 126, the outlet conduit 128, the expansion device 130, and the tubing 132, and may output signals indicative of the sensed data to the control system 102. The ambient condition data may include a temperature, humidity, pressure, air flow rate, and/or air quality at and/or adjacent to certain components. For example, during operation of the evaporator section 120, the temperature, humidity, pressure, air flow rate, and/or air quality within the evaporator section 120 may fluctuate, such as due to air flowing through the evaporator section 120 and/or heat exchange between the air and the refrigerant flowing through the inlet conduit 126, the outlet conduit 128, the expansion device 130, the tubing 132, and/or the evaporator 122 generally. In operation, the sensors 104 may measure such fluctuations. Additionally, vibration data detected by the sensors 104 may include sensed vibration amounts and/or sensed vibration frequencies at certain components. For example, during operation of the evaporator section 120, components of the HVAC system 100 within the evaporator section 120 may vibrate due to air flowing through the evaporator section 120, refrigerant flowing through the components, couplings between the components, and other features/interactions that may induce vibrations.

Additionally or alternatively, air may flow from the evaporator section 120 into a blower section 140 of the HVAC system 100. The blower section 140 may facilitate/drive air flow through the HVAC system 100. For example, as described above, the blower 110 of the blower section 140 may draw the air flow into the intake section 106, through the air filter 114, and through the evaporator section 120. The blower 110 may be any suitable blower, such as forward curved fan, a plenum fan, or another type of fan/blower configured to direct air. The blower 110 may include a shaft bearing 142 rotatably coupled to and configured to facilitate rotation of a fan 144, such as a fan wheel, of the blower 110. The blower 110 may be mounted to a wall 146 of the blower section 140 via a bracket 148, which may secure the blower 110 within the HVAC system 100. In certain embodiments, the blower 110 may be secured within the HVAC system 100 via other features, such as fasteners, adhesive, or other brackets, in addition to or in place of the bracket 148. The blower 110 may direct air into a heater section 160 or another section, such as a discharge section, of the HVAC system 100, as indicated by arrow 162.

The blower section 140 may include sensors 104 disposed at and coupled to certain components, such as the shaft bearing 142 of the blower 110 and/or the bracket 148. The sensors 104 may sense ambient conditions and vibrations of certain components, such as the shaft bearing 142 and the bracket 148, and may output signals indicative of the sensed data to the control system 102. For example, during operation of the blower section 140, the temperature, humidity, pressure, air flow rate, and/or air quality within the blower section 140 may fluctuate, such as due to air flowing through the blower section 140, and the sensors 104 may measure such fluctuations. Additionally, vibration data collected by the sensors 104 may include vibration amounts and/or vibration frequencies of certain components. For example, during operation, components within the blower section 140 may vibrate due to air flowing through the blower 110, due to relative movement of the components at couplings between the components, and/or due to other features/interactions that may induce vibrations. More specifically, the shaft bearing 142 may vibrate due to rotation of the fan 144 and/or due to forces applied by a motor of the HVAC system 100 that is configured to operate the blower 110. Additionally, the bracket 148 may vibrate due to the rotation of the fan 144 and/or operation of the blower 110 generally.

The heater section 160 may include a heater 164, such as a gas heater or an electric heater, configured to heat air within the heater section 160. For example, air directed into the heater section 160 from the blower section 140, as indicated by arrow 162, may flow downwardly toward and over the heater 164. A working fluid may flow through coiled tubing 170 of the heater 164, the air may pass over the coiled tubing 170, and the air may absorb heat from the working fluid, thereby heating the air as the air passes through the heater section 160. In some embodiments, the heater 164 may include an inlet conduit 172 coupled to the coiled tubing 170 that supplies the working fluid into the coiled tubing 170. For example, the inlet conduit 172 may be a component of a burner assembly of the heater 164. Additionally, the heater 164 may include an outlet conduit 174 coupled to the coiled tubing 170 that receives the working fluid from the coiled tubing 170 after the air absorbs heat from the working fluid. The outlet conduit 174 may direct the working fluid to the ambient environment surrounding the HVAC system 100 or to another location. It some embodiments, the heater 164 may be configured to circulate a refrigerant therethrough, and in such embodiments, the inlet conduit 172 and the outlet conduit 174 may be coupled to other refrigerant tubing and/or to other devices/components within the HVAC system 100. The coiled tubing 170, the inlet conduit 172, and/or the outlet conduit 174 may be any suitable tubing, such as tubing including copper and/or aluminum. Air may exit the heater section 160, such as via a bottom discharge port or a side discharge port, and may flow into a building connected to the HVAC system 100 or other suitable conditioned space in order to provide the space with conditioned air. It will be appreciated that, in some embodiments, the heater section 160 may instead be a discharge section that does not include the heater 164. Instead, the discharge section may be configured to simply receive air from the blower section 140 and discharge the air toward a conditioned space, such as via ductwork fluidly connected to the HVAC system 100.

The heater section 160 may include sensors 104 disposed at and coupled to certain components, such as the inlet conduit 172 and/or the outlet conduit 174. The sensors 104 may sense ambient conditions and vibrations at certain components, such as the inlet conduit 72 and/or the outlet conduit 174, and may output signals indicative of the sensed data to the control system 102. The ambient condition data may include a temperature, humidity, pressure, air flow rate, and/or air quality at and/or adjacent to certain components. For example, during operation of the heater section 160, the temperature, humidity, pressure, air flow rate, and/or air quality within the heater section 160 may fluctuate, such as due to air flowing through the heater section 160 and/or heat exchange between air and the working fluid flowing through the inlet conduit 172, the outlet conduit 174, and/or the heater 164 generally, and the sensors 104 may measure such fluctuations. Additionally, vibration data collected by the sensors 104 may include sensed vibration amounts and/or sensed vibration frequencies at certain components within the heater section 160. For example, during operation of the heater section 160, certain components may vibrate due to air flowing through the heater section 160, working fluid flowing through the components, couplings between the components, and other features/interactions that may induce vibrations.

Additionally, the HVAC system 100 may include a condenser section 180 that receives air from other portions of the HVAC system 100 and/or from an ambient environment surrounding the HVAC system 100. Air may flow over condensers 182 of the condenser section 180, as indicated by arrows 184, thereby cooling and condensing refrigerant flowing through the condensers 182 as the air absorbs heat from the refrigerant. For example, the condenser section 180 may include fans 186 configured to rotate to draw air through the condenser section 180 and over the condensers 182. As illustrated, each fan 186 may include shaft 188 and blades 190. Additionally, motors 192 of the condenser section 180 may drive rotation of a respective shaft 188 of one of the fans 186, thereby causing the blades 190 of the fan 186 to rotate and draw air through the condenser section 180. Refrigerant may flow through coiled tubing of each condenser 182, air may pass over the coiled tubing, and the air may absorb heat from the refrigerant, thereby cooling the refrigerant as the air passes through the condenser section 180. The condenser section 180 may include an inlet conduit 194 coupled to each condenser 182 that supplies refrigerant into the coiled tubing of the condenser 182. Additionally, the condenser section 180 may include an outlet conduit 196 coupled to each condenser 182 that receives refrigerant from the condenser 182 after heat is transferred from the refrigerant to the air.

The condenser section 180 may also include sensors 104 disposed at and coupled to certain components, such as the motors 192, the inlet conduits 194, and/or the outlet conduits 196. The sensors 104 may sense ambient conditions and vibrations at certain components, such as the motors 192, the inlet conduits 194, and/or the outlet conduits 196, and may output signals indicative of the sensed data to the control system 102. The ambient condition data may include a temperature, humidity, pressure, air flow rate, and/or air quality at and/or adjacent to certain components. For example, during operation of the condenser section 180, the temperature, humidity, pressure, air flow rate, and/or air quality within the condenser section 180 may fluctuate, such as due to air flowing through the condenser section 180 and/or heat exchange between air and the refrigerant flowing through the inlets 194, the outlets 196, and/or the condensers 182 generally, and the sensors 104 may measure such fluctuations. Additionally, vibration data collected by the sensors 104 may include sensed vibration amounts and/or sensed vibration frequencies at or on certain components. For example, during operation of the condenser section 180, certain components, such as the motors 192, the inlet conduits 194, the outlet conduits 196, and/or the condensers 182 generally, may vibrate due to air flowing through the condenser section 180, refrigerant flowing through the components, couplings between the components, and other features/interactions that may induce vibrations.

The HVAC system 100 may further include an exhaust section 197 configured to exhaust air from a building or other conditioned space to an environment, as indicated by arrow 198. Additionally, the HVAC system 100 may include an enclosure 199, such as a cabinet, that may house the intake section 106, the evaporator section 120, the blower section 140, the heater section 160, the condenser section 180, and/or the exhaust section 197. In certain embodiments, sensors 104 may be coupled to and configured to detect ambient condition information and vibration information at the exhaust section 197 and/or the enclosure 199.

The HVAC system 100 may include compressors 200 that may increase the pressure and temperature of the refrigerant within the HVAC system 100, such as before the refrigerant enters the evaporator 122 and/or the condensers 182. The compressors 200 may be any suitable type of compressors, such as scroll compressors, rotary compressors, screw compressors, or reciprocating compressors. In some embodiments, the compressors 200 may include a pair of hermetic direct drive compressors arranged in a dual stage configuration. However, in other embodiments, any number of the compressors 200 may be provided to achieve various stages of heating and/or cooling. As illustrated, the compressors 200 are disposed in the condenser section 180 of the HVAC system 100. In other embodiments, the compressors 200 may be disposed in other sections of the HVAC system 100. As may be appreciated, additional equipment and devices may be included in the HVAC unit 12, such as a solid-core filter drier, a drain pan, a disconnect switch, an economizer, pressure switches, phase monitors, and humidity sensors, among other components.

In some embodiments, the HVAC system 100 may include sensors 104 disposed at and/or coupled to the compressors 200. For example, the sensors 104 may be coupled to stubs of the compressors 200, which may be inlet conduits through which the compressors 200 receive refrigerant and/or outlet conduits through which the compressors 200 discharge refrigerant. The sensors 104 may sense ambient conditions and vibrations at the compressors 200 and may output signals indicative of the sensed data to the control system 102. The ambient condition data may include a temperature, humidity, pressure, air flow rate, and/or air quality at and/or adjacent to each compressor 200. Additionally, vibration data may include sensed vibration amounts and/or sensed vibration frequencies at the compressors 200. For example, during operation of the compressors 200, the stubs of each compressor 200 may vibrate due to refrigerant flowing through the stubs, refrigerant flowing through the compressors 200, operation of the compressors 200 generally, and other features/interactions that may induce vibrations.

In certain embodiments, sensors 104 may be coupled to and configured to detect ambient condition information and/or vibration information at other components of the HVAC system 100. For example, the sensors 104 may be coupled to and configured to detect ambient condition information and vibration information at return and/or exhaust fans of the HVAC system 100, an economizer of the HVAC system 100, high-pressure and/or low-pressure switches of the HVAC system 100, refrigerant valve(s) of the HVAC system 100, an energy recovery wheel of the HVAC system 100, a steam humidifier of the HVAC system 100, a final and/or high efficiency particulate air (HEPA) filter of the HVAC system 100, other portions of a refrigerant circuit of the HVAC system 100, and other locations/components of the HVAC system 100. The sensors 104 are configured to detect ambient and/or vibration data and transmit the data to the data analyzer 101 of the control system 102, such that the control system 102, via the data analyzer 101, may determine the RUL for certain components based on the ambient condition information and the vibration information.

The data analyzer 101 of the control system 102 may include a processor 202 and a memory 204. The processor 202 may be used to execute software, such as software stored in the memory 204, for controlling the HVAC system 100. Moreover, the processor 202 may include multiple microprocessors, one or more "general-purpose" microprocessors, one or more special-purpose microprocessors, and/or one or more application specific integrated circuits (ASICS), or some combination thereof. For example, the processor 202 may include one or more reduced instruction set (RISC) or complex instruction set (CISC) processors. The memory 204 may include a volatile memory, such as random access memory (RAM), and/or a nonvolatile memory, such as read-only memory (ROM). The memory 204 may store a variety of information and may be used for various purposes. For example, the memory 204 may store processor-executable instructions, such as firmware or software for controlling the HVAC system 100, for the processor 202 to execute. The memory 204 may include ROM, flash memory, a hard drive, or any other suitable optical, magnetic, or solid-state storage medium, or a combination thereof. The memory 204 may store data, instructions, and any other suitable data. The processor 202 and/or the memory 204 may be located in any suitable portion of the system. For example, the memory 204 for storing instructions, such as software or firmware for controlling portions of the HVAC system 100, may be located in or associated with any control system. The memory 204 may be any suitable article of manufacture that can serve as a medium to store processor-executable code, data, or the like. These articles of manufacture may represent computer-readable medium or any suitable form of memory or storage that may store the processor-executable code used by the processor 202 to perform the presently disclosed techniques. The memory 204 may also be used to store the data and various other software applications. The memory 204 may represent a non-transitory computer-readable storage medium or any suitable form of memory or storage that may store the processor-executable code used by the processor 202. It should be noted that non-transitory merely indicates that the medium is tangible and not a signal. In certain embodiments, the memory 204 may be a cloud-based memory and/or the data analyzer 101 may access a cloud-based memory.

Figure 6:
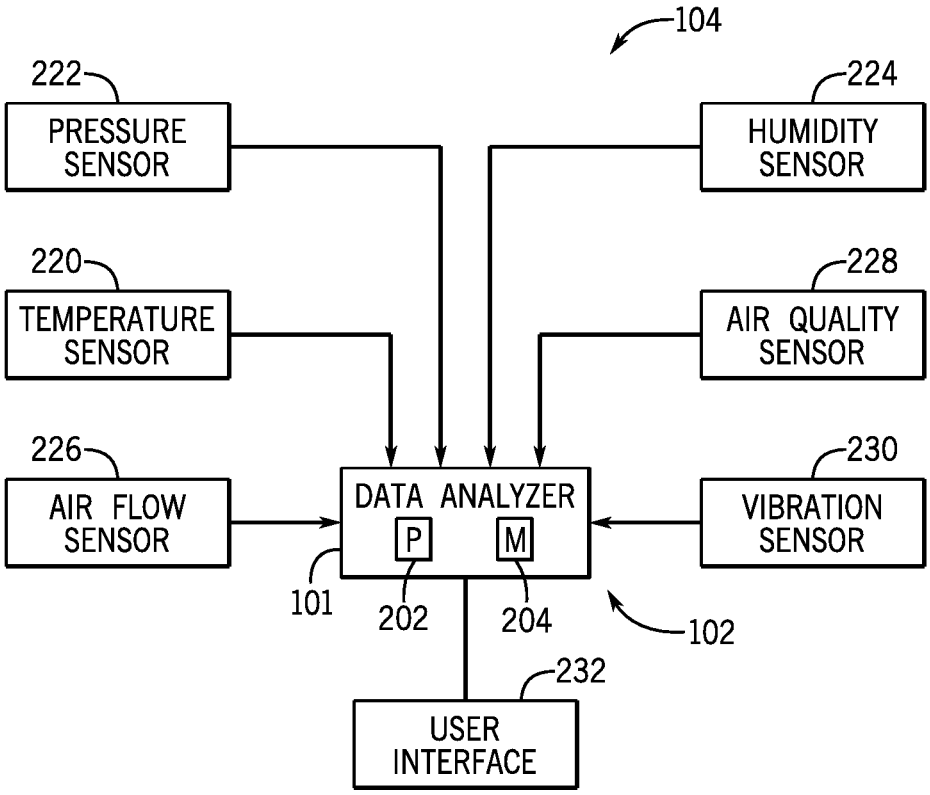
FIG. 6 is a schematic of an embodiment of a sensor system that may be used in an HVAC system, in accordance with an aspect of the present disclosure.

FIG. 6 is a schematic of an embodiment of the data analyzer 101 of the control system 102 communicatively coupled with the sensors 104 of the HVAC system 100. As illustrated, the sensors 104 include ambient condition sensors, including a temperature sensor 220 configured to detect and output a signal indicative of a temperature, a pressure sensor 222 configured to detect and output a signal indicative of a pressure, a humidity sensor 224 configured to detect and output a signal indicative of a humidity, an air flow sensor 226 configured to detect and output a signal indicative of an air flow, and an air quality sensor 228 configured to detect and output a signal indicative of an air quality. The sensors 104 also include a vibration sensor 230, which may be a transducer. The vibration sensor 230 may include any suitable sensor(s) configured to detect and output a signal indicative of vibrations and/or to provide data suitable for determining vibrations at or of one or more components of the HVAC system 100. For example, the vibration sensor 230 may output a signal indicative of strain, stress, acceleration, and/or displacement at one or more components of the HVAC system 100. More specifically, the vibration sensor 230 may include a strain gauge, an accelerometer, and/or other suitable transducers.

The control system 102 may be configured to receive and process the signals received from the sensors 104. For example, based on the signals indicative of the ambient conditions received from ambient condition sensors at a particular component of the HVAC system 100, the data analyzer 101 may determine the temperature, pressure, humidity, air flow, and/or air quality near the component. Based on the signals indicative of vibrations and/or other data received from the vibration sensor 230, the data analyzer 101 may determine vibrations induced in the component. For example, based on the received data from the vibration sensor 230, the data analyzer 101 may determine a vibration profile of the component, including an amplitude, frequencies, a stress ratio, and other measurements/calculations. Additionally, the data analyzer 101 may be configured to amplify and otherwise condition the signals received from the sensors 104. In some embodiments, the HVAC system 100 may include a preamplifier signal conditioner at each vibration sensor 230 that is configured to pre-amplify and otherwise condition the signals output by the vibration sensor 230 prior to receipt by the control system 102. In certain embodiments, the control system 102 may switch between multiple channels, where each channel is associated with a specific transducer disposed on or near a component, such that the control system 102 may switch between the multiple channels to receive/determine the vibrations at multiple components of the HVAC system 100.

In certain embodiments, the control system 102 may include the data analyzer 101 configured to determine the RUL for components of the HVAC system 100. For example, the memory 204 may store instructions for execution of the data analyzer 101, and the instructions may be executed by the processor 202. More specifically, after receiving data from the sensors 104, the data analyzer 101, via the processor 202, may select a particular RUL analytical model based on an indication of a parameter received from the sensors 104, such as an ambient condition and/or based on a material characteristic of the respective component, such as a type of material. The data analyzer 101 may select the particular RUL analytical model from multiple RUL analytical models stored in the memory 204 and/or stored in another memory. For example, the multiple analytical models may be stored in a cloud-based memory of memory 204 and/or of another memory. The data analyzer 101 may determine an indication of the RUL for the respective component based on applying the particular RUL analytical model using the input from the vibration sensor 230 and/or determined vibration data/profile. As used herein, the data analyzer 101 determining the indication of the RUL based on applying the particular RUL analytical model using the input from the vibration sensor 230 and/or the determined vibration data/profile may generally refer to providing the input from the vibration sensor 230 and/or the determined vibration data/profile as an input to the particular RUL analytical model, and the particular RUL analytical model generating/determining the indication of the RUL based on the input.

After determining the RUL indication, the data analyzer 101 may output the RUL indication for display at the user interface 232 of the HVAC system 100. The user interface 232 may display RUL indications for multiple components of the HVAC system 100 and/or may provide an alert/notification based on the RUL indications for viewing by service personnel. Additionally or alternatively, the control system 102 may perform a control operation of the HVAC system 100 based on one or more RUL indications, such as de-rating a component of the HVAC system 100 and/or the HVAC system 100 generally, controlling operation of a component of the HVAC system 100 and/or the HVAC system 100 generally, shutting down a component of the HVAC system 100 and/or the HVAC system 100 generally, and other suitable control operations. The user interface 232 may operate to depict visualizations associated with software or executable code being processed by the processor 202. In one embodiment, the user interface 232 may be a touch display capable of receiving inputs from service personnel. The user interface 232 may be any suitable type of display, such as a liquid crystal display (LCD), plasma display, or an organic light emitting diode (OLED) display, for example. In certain embodiments, the user interface 232 may be a display of the HVAC system 100, a mobile device, such as a mobile device of service personnel and/or an owner of the HVAC system 100, a computing device of a service provider, a computing device of a homeowner and/or the owner of the HVAC system 100, or a display of other suitable devices.

Figure 7:
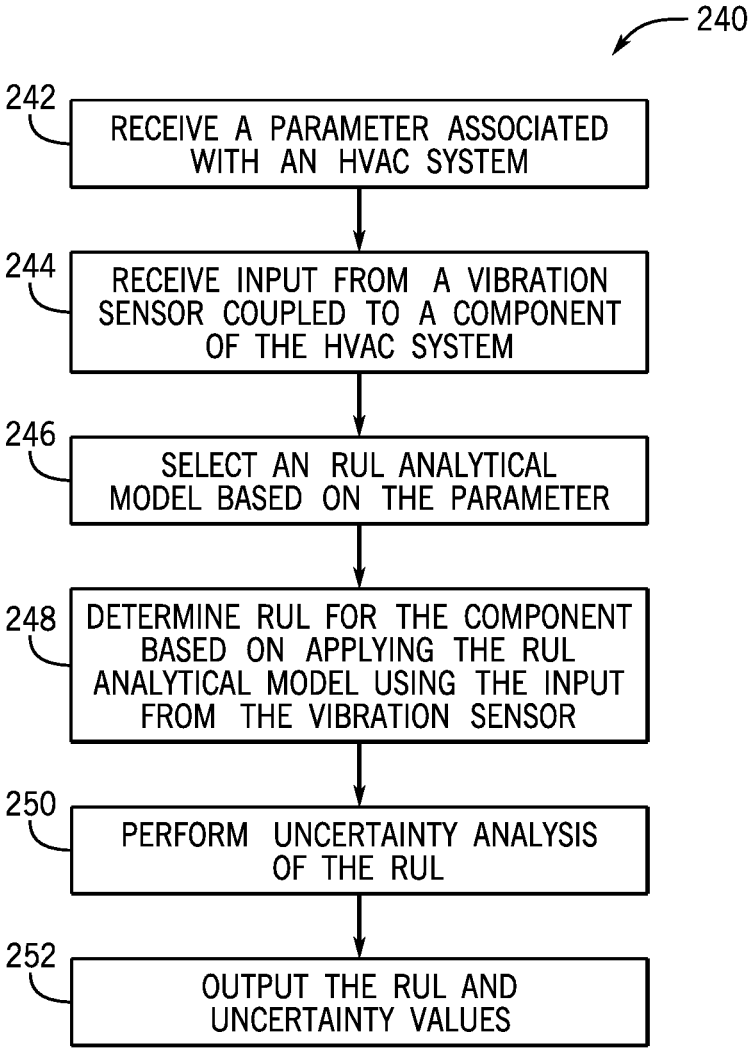
FIG. 7 is a flow diagram of an embodiment of a process for determining a remaining useful life (RUL) of a component of an HVAC system, in accordance with an aspect of the present disclosure.

FIG. 7 is a flow diagram of an embodiment of a process 240 for determining an RUL of a component of the HVAC system 100. In certain embodiments, the control system 102 of the HVAC system 100, via the data analyzer 101, may perform some or all steps of the process 240. At block 242, the control system 102 may receive a parameter associated with the HVAC system 100. The parameter may include an ambient condition of the HVAC system 100, such as a temperature, humidity, pressure, air flow, and/or air quality at and/or adjacent to a component of the HVAC system 100, a material characteristic of a component of the HVAC system, such as a material type or a material age, or another suitable parameter. In certain embodiments, the HVAC system 100 may receive signal(s) from ambient condition sensors of the sensors 104 and may determine the parameter associated with the HVAC system 100 based on the received signals. For example, the HVAC system 100 may receive multiple signals from the sensors 104, each signal indicative of a different type of ambient condition. Each type of ambient condition may affect the RUL of the component differently and/or may correspond to a different RUL analytical model. As such, the control system 102 may select a particular ambient condition from the multiple types of ambient conditions to determine/receive the parameter associated with the HVAC system 100.

At block 244, the control system 102 may receive an input from the vibration sensor 230 of the sensors 104 associated with the component of the HVAC system 100. The vibration sensor 230 may be coupled to the component or may be disposed adjacent to the component. The input from the vibration sensor 230 may include a signal indicative of vibrations and/or data suitable for determining vibrations of the component of the HVAC system 100. For example, based on the received data from the vibration sensor 230, the control system 102 may determine a vibration profile of the component, which may include an amplitude, frequencies, a stress ratio, and other measurements/calculations of the vibrations.

At block 246, the control system 102 may select an RUL analytical model based on the parameter received/determined at block 242. For example, the control system 102 may select the RUL analytical model from a library of RUL analytical models. In some embodiments, each RUL analytical model of the library of RUL analytical models is developed specifically for determining the RUL of a component based on one or more particular parameters. The library of RUL analytical models may include physics-based models, statistic-based models, artificial intelligence models, and/or hybrid models. In certain embodiments, the library of RUL analytical models may include only physics-based models, such as a Walker RUL estimation model, Foreman RUL estimation model, Shin RUL estimation model, Morrow RUL estimation model, and other suitable approaches/models. Such physics-based models may provide more accurate RUL estimations compared to other models, such as statistic-based models, the artificial intelligence models, and/or the hybrid models.

In some embodiments, the physics-based models may account for physics associated with the received parameter, such as the ambient condition and/or material characteristic/type, and a potential fault mechanism of the component. For example, the control system 102 may select an RUL analytical model that uses the Walker RUL estimation if the component of the HVAC system 100 includes copper and/or if the sensors 104 include an accelerometer. By way of another example, the control system 102 may select an RUL analytical model that uses the Foreman RUL estimation if the component of the HVAC system 100 includes copper and/or if the received parameter from sensors 104 includes a temperature. Additionally, the control system 102 may select an RUL analytical model that uses the Shiri RUL estimation if the component of the HVAC system 100 includes copper and/or if the received parameter from sensors 104 includes a humidity measurement. Further, the control system 102 may select an RUL analytical model that uses the Morrow RUL estimation if the component of the HVAC system 100 includes aluminum and/or if the received parameter from sensors 104 includes a pressure measurement. In certain embodiments, the RUL analytical model may be selected at least partially based on a type of potential fault mechanism of the component, such as a crack, leak, noise, fracture, or other fault mechanisms. The physics associated with each potential fault mechanism may be accounted for via the physics-based RUL analytical model.

At block 248, the control system 102 may determine the RUL for the component of the HVAC system 100 based on applying the selected RUL analytical model using the input from the vibration sensor 230. As described above, the vibration sensor 230 may detect and output a signal indicative of vibrations and/or to provide data suitable for determining vibrations of the component of the HVAC system 100. For example, the vibration sensor 230 may output a signal indicative of strain, stress, acceleration, and/or displacement of the component of the HVAC system 100. The control system 102 may use such vibration data to determine the RUL of the component via the selected RUL analytical model. The control system 102 may determine the RUL as a numerical value, such as one hour, one day, one week, two weeks, one month, two months, six months, one year, five years, or twenty years, as a percentage of a maximum or recommend life of the component, such as ten percent, twenty percent, forty percent, or eighty percent, or as other suitable values.

At block 250, the control system 102 may perform an uncertainty analysis of the RUL of the component of the HVAC system 100. The uncertainty analysis may provide a range of the RUL of the component and may account for certain variables that may affect the RUL, such as active component usage, degradation of the component that may be initiated and/or accelerated by interaction with other components, and other factors. In certain embodiments, the range of the RUL may be provided as a numerical range of the numerical value or as a range of the percentage value of the RUL.

At block 252, the control system 102 may output the RUL of the component of the HVAC system 100 and any associated uncertainty values, such as to the user interface 232 of the HVAC system 100. The user interface 232 may display the RUL for components of the HVAC system 100 and/or may provide an alert/notification based on the RUL indications for viewing by service personnel and/or by an owner of the HVAC system 100. Additionally or alternatively, the control system 102 may perform a control operation of the HVAC system 100 based on the RUL indication, such as de-rating one or more components of the HVAC system 100 and/or the HVAC system 100 generally, controlling operation of one or more components of the HVAC system 100 and/or the HVAC system 100 generally, shutting down one or more components of the HVAC system 100 and/or the HVAC system 100 generally, and other suitable control operations.

Providing such alerts/notifications and/or control of the HVAC system 100 may enable improved replacement of certain components of the HVAC system 100, such as by reducing operation of and/or shutting down the components prior to fault mechanisms occurring at the components. For example, if the RUL indication determined and output by the data analyzer 101 of the control system 102 for a section of refrigerant tubing in the HVAC system 100 is one month, service personnel may replace the section of refrigerant tubing within one month to avoid and/or reduce a probability of the fault mechanism occurring at the section of refrigerant tubing. By way of another example, if the RUL indication determined and output by the data analyzer 101 of the control system 102 for the section of refrigerant tubing is one hour, the control system 102 may automatically reduce operation of and/or shutdown the portion of the HVAC system 100 having the section of refrigerant tubing to avoid and/or reduce a probability of the fault mechanism occurring at the section of refrigerant tubing.

After performing the step of block 252, the control system 102 may return to any of the previous blocks, including blocks 242-250, to continue determining the RUL for other components of the HVAC system 100 and may iteratively perform process 240 to determine the RUL of various components of the HVAC system 100. As such, the control system 102, via the process 240, enables improved operation of the HVAC system 100 by reducing the probability of certain fault mechanisms occurring at certain components, thereby improving efficiency of the HVAC system 100 and reducing costs associated with the HVAC system 100.

Figure 8:
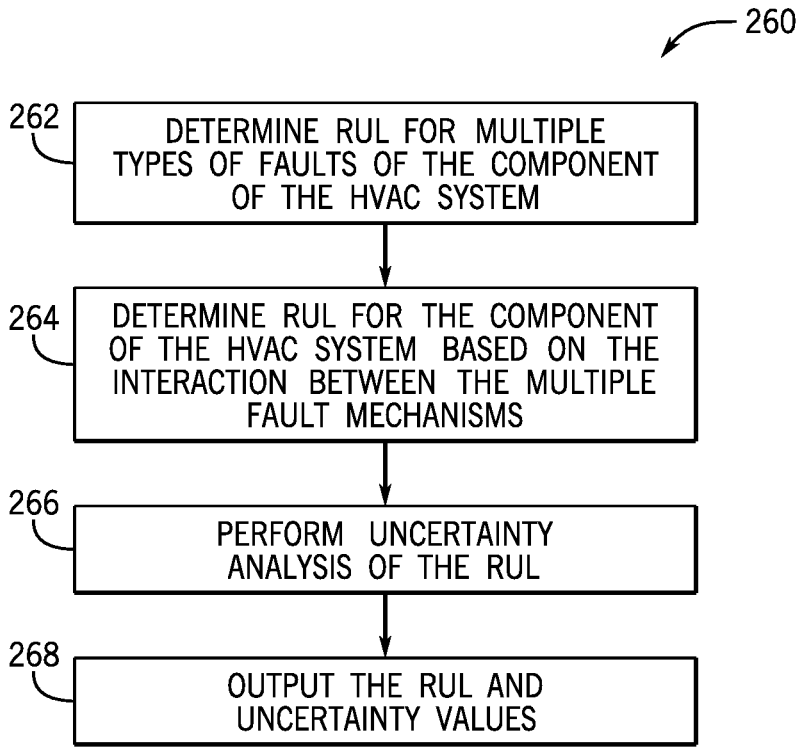
FIG. 8 is a flow diagram of an embodiment of a process for determining an RUL of a component of an HVAC system, in accordance with an aspect of the present disclosure.

FIG. 8 is a flow diagram of an embodiment of a process 260 for determining an RUL of a component of the HVAC system 100. In certain embodiments, the control system 102 of the HVAC system 100, via the data analyzer 101, may perform some or all steps of the process 260. At block 262, the control system 102 may determine the RUL for multiple types of faults and/or fault mechanisms for a component of the HVAC system 100. For example, the control system 102 may perform blocks 242, 244, 246, and 248 of process 240 for each type of potential fault mechanism for the component, thereby generating multiple RUL indications for the component.

At block 264, the control system 102 may determine the RUL of the component, such as an overall RUL or a total RUL, based on the multiple RUL indications determined at block 262 and/or based on interactions between the multiple types of faults and fault mechanisms of the component. For example, a first type of fault mechanism of a component may cause a second type of fault mechanism of the component to initiate and/or accelerate, which may affect the RUL determined based on the first type of fault mechanism and/or the RUL determined based on the second type of fault mechanism. The control system 102 may account for such interactions when determining the RUL of the component, such as the overall RUL. In certain embodiments, the control system 102 may determine the RUL of the component based on a probability of each type of fault mechanism occurring. If a first type of fault mechanism is unlikely to occur, and a second type of fault mechanism dominates the first type of fault mechanism, such as due to the second type having a higher probability of occurrence, the first type of fault mechanism may be neglected in the determination of the RUL of the component. In some embodiments, the interaction between types of faults and/or fault mechanisms may be neglected, and the control system 102 may determine the RUL of the component based on the respective RUL determined for each type of fault mechanism. For example, the control system 102 may determine the RUL of the component as an average of multiple RUL indications determined for respective types of fault mechanisms. Additionally or alternatively, the control system 102 may assign some RUL indications higher values due to those RUL indications being more probable to occur. In such embodiments, the determined RUL of the component may be a weighted average of multiple RUL indications.

In certain embodiments, the potential fault mechanism interactions, the probability of each fault mechanism occurring, the probability of each fault mechanism interaction occurring, and/or other data related to the fault mechanisms may depend on a type of the component, a location of each fault mechanism along/within the component, a location of the component, a material characteristic of the component, and other factors that may affect the fault mechanisms. Such data related to the fault mechanisms may be stored in the memory 204 and/or in another memory accessible by the data analyzer 101, and/or by the control system 102 generally, to determine the RUL indication(s). For example, the memory 204 and/or another memory may include a database having such data.

At block 266, the control system 102 may perform uncertainty analysis of the RUL of the component of the HVAC system 100. The uncertainty analysis may provide a range of the RUL of the component and may account for certain variables that may affect the RUL, such as active component usage, degradation of the component, and other factors.

At block 268, the control system 102 may output the RUL of the component of the HVAC system 100 along with any associated uncertainty values, such as to the user interface 232 of the HVAC system 100. The user interface 232 may display the RUL for various components of the HVAC system 100 and/or may provide an alert/notification based on the RUL indication for viewing by service personnel and/or by an owner of the HVAC system 100. Additionally or alternatively, the control system 102 may perform a control operation of the HVAC system 100 based on the RUL indications, such as de-rating one or more components of the HVAC system 100 and/or the HVAC system 100 generally, controlling operation of one or more components of the HVAC system 100 and/or the HVAC system 100 generally, shutting down one or more components of the HVAC system 100 and/or the HVAC system 100 generally, or other suitable control operations. Providing such alerts/notifications and/or control of the HVAC system 100 may enable improved replacement of certain components of the HVAC system 100, such as by reducing operation of and/or shutting down one or more components or by enabling other operations prior to fault mechanisms occurring at the components.

After performing block 268, the control system 102 may return to any of the previous steps, including blocks 262-266, to continue determining the RUL for components of the HVAC system 100 and may iteratively perform the process 260 to determine the RUL of the components of the HVAC system 100. As such, the control system 102, via the process 260, enables improved operation of the HVAC system 100 by reducing the probability of certain fault mechanisms occurring at certain components, thereby improving efficiency of the HVAC system 100 and reducing costs associated with the HVAC system 100.

Figure 9:
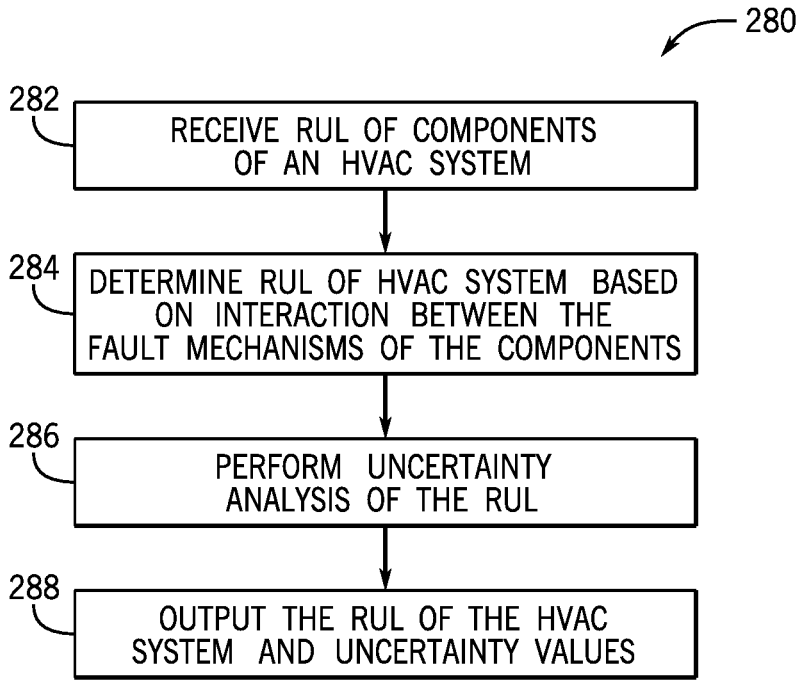
FIG. 9 is a flow diagram of an embodiment of a process for determining an RUL of an HVAC system, in accordance with an aspect of the present disclosure.

FIG. 9 is a flow diagram of an embodiment of a process 280 for determining an RUL of the HVAC system 100. In certain embodiments, the control system 102 of the HVAC system 100, via the data analyzer 101, may perform some or all steps of the process 280. At block 282, the control system 102 may determine the RUL for multiple components of the HVAC system 100. For example, the control system 102 may perform blocks 242, 244, 246, and 248 of process 240 for each type of potential fault mechanism for multiple components of the HVAC system 100, resulting in one or more RUL indications for the multiple components of the HVAC system 100. In certain embodiments, the control system 102 may also perform blocks 262 and 264 of process 260 to determine the RUL, such as an overall RUL, for one or more components of the HVAC system 100 based on multiple fault mechanisms of the components and based on potential interactions among the multiple fault mechanisms of the components.

At block 284, the control system 102 may determine the RUL of the HVAC system 100 based on the RUL indication determined for certain components at block 282 and/or based on interactions between the components and the fault mechanisms of the components. For example, a fault mechanism of a first component may cause a fault mechanism of a second component to initiate and/or accelerate, which may affect the RUL of the HVAC system 100 generally. The control system 102 may account for such interactions when determining the RUL of the HVAC system 100. In certain embodiments, the control system 102 may determine the RUL of the HVAC system 100 based on a probability of a fault mechanism occurring at one or more components of the HVAC system 100. If a fault mechanism at a first component is unlikely to occur, and a fault mechanism at a second component is more likely to occur, the fault mechanism at the first component may be neglected in determining the overall RUL of the HVAC system 100. In some embodiments, the interaction between faults components of multiple components and the control system 102 may determine the general RUL of the HVAC system 100 based on the RUL determined for the components evaluated. For example, the control system 102 may determine the RUL of the HVAC system 100 as an average of the multiple RUL indications determined for the respective components. Additionally or alternatively, the control system 102 may assign some RUL indications higher values due to those RUL indications being more probable to occur.

In certain embodiments, the potential fault mechanism interactions of the components, the probability of each fault mechanism occurring, the probability of each fault mechanism interaction occurring, and/or other data related to the fault mechanisms may depend on data indicative of the components of the HVAC system, such as type(s) of the components, a location of each potential fault mechanism along/within the component, a location of each component, material characteristic(s) of the components, and other factors that may affect the fault mechanisms. Such data related to the potential fault mechanisms and fault mechanism interactions may be stored in the memory 204 and/or in another memory accessible by the data analyzer 101, and/or by the control system 102 generally, to determine the RUL indication(s). For example, the memory 204 and/or another memory may include a database having such data.

At block 286, the control system 102 may perform an uncertainty analysis of the RUL of the HVAC system 100. The uncertainty analysis may provide a range of the RUL and may account for certain variables that may affect the RUL, such as active component usage, degradation of certain components, and other factors.

At block 288, the control system 102 may output the RUL of the HVAC system 100 and any associated uncertainty values, such as to the user interface 232 of the HVAC system 100. The user interface 232 may display the RUL of the HVAC system 100 and/or may provide an alert/notification based on the RUL indication for viewing by service personnel and/or by an owner of the HVAC system 100. Additionally or alternatively, the control system 102 may perform a control operation based on the RUL indication, such as de-rating the HVAC system 100, controlling operation of component(s) of the HVAC system 100 and/or the HVAC system 100 generally, shutting down component(s) of the HVAC system 100 and/or the HVAC system 100 generally, and/or other suitable control operations. Providing such alerts/notifications and/or control of the HVAC system 100 may enable improved repair or replacement of certain components of the HVAC system 100, thereby reducing undesired operation of and/or shutting down the HVAC system 100.

After performing block 288, the control system 102 may return to any of the previous steps discussed above, such as the steps of blocks 282-286, to continue determining the RUL of the HVAC system 100 and may iteratively perform the process 280 to determine and/or update the RUL of the HVAC system 100. As such, the control system 102, via the process 280, enables improved operation of the HVAC system 100 by reducing the probability of certain fault mechanisms occurring at certain components, thereby improving efficiency of the HVAC system 100 and reducing costs associated with the HVAC system 100.

Accordingly, the present disclosure provides systems and methods for determining the RUL of components of an HVAC system. The disclosed techniques enable improved operation of an HVAC system by reducing a probability of certain fault mechanisms occurring at certain components of the HVAC system, thereby improving efficiency of the HVAC system and reducing costs associated with the HVAC system. For example, the HVAC system may include a control system that determines an RUL of certain components of the HVAC system and/or of the HVAC system generally based on certain data, such as ambient conditions near the components, material characteristics of the components, vibrations and/or vibration profiles of the components, and other factors. The control system may output the RUL of the components and/or the HVAC system generally for display to service personnel and/or an owner of the HVAC system and/or may control operation of the HVAC system based on the RUL. For example, the control system may provide such notifications/alerts and/or may control or adjust operations of the HVAC system prior to the occurrence of certain fault mechanisms. As such, the systems and methods described herein increase uptime of the HVAC system, improve efficiency of the HVAC system, and reduce costs associated with the HVAC system.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and/or air conditioning (HVAC) system with a vibration sensor coupled to a component of the HVAC system and comprising a data analyzer with a processor configured to:

receive an input from the vibration sensor coupled to the component of the HVAC system;

receive an indication of a parameter associated with the HVAC system;

select, based on the indication of the parameter, an analytical model from a plurality of analytical models stored in a memory, wherein each analytical model of the plurality of analytical models is configured to calculate a remaining useful life (RUL) of the component;

determine an RUL indication for the component of the HVAC system based on applying the analytical model using the input from the vibration sensor;

output the RUL indication;

determine fault mechanism interactions between the component and an additional component of the HVAC system based on data indicative of the component and of the additional component; and determine an overall RUL indication for the HVAC system based on the RUL indication for the component and the fault mechanism interactions between the component and the additional component.

2. The HVAC system of claim 1, wherein the indication of the parameter is a value of an ambient condition of the HVAC system.

3. The HVAC system of claim 2, comprising an ambient condition sensor configured to provide the indication of the parameter, wherein the ambient condition is an ambient temperature, an ambient humidity, an ambient air quality, an ambient pressure, or any combination thereof.

4. The HVAC system of claim 1, wherein the indication of the parameter corresponds to a material characteristic of the component of the HVAC system.

5. The HVAC system of claim 4, wherein the material characteristic of the component is a material type of the component, and wherein the material type is copper, aluminum, steel, plastic, or any combination thereof.

6. The HVAC system of claim 1, wherein the plurality of analytical models includes a plurality of physics-based models, and wherein each physics-based model is configured to provide the RUL indication based on the input from the vibration sensor and physics associated with potential fault mechanisms of the component of the HVAC system.

7. The HVAC system of claim 1, comprising a user interface configured to display the RUL indication, provide an alert indicative of the RUL indication, or both, wherein the data analyzer is configured to output the RUL indication to the user interface.

8. A non-transitory computer readable storage medium for a heating, ventilation, and/or air conditioning (HVAC) system comprising instructions that, when executed by a processor, cause the processor to:

receive an input from a vibration sensor coupled to a component of the HVAC system;

receive an indication of a parameter associated with the HVAC system;

select, based on the indication of the parameter, an analytical model from a library of analytical models stored in a memory, wherein each analytical model of the library of analytical models is configured to calculate a remaining useful life (RUL) of the component;

determine and output an RUL indication for the component of the HVAC system based on applying the analytical model using the input from the vibration sensor;

determine fault mechanism interactions between the component and an additional component of the HVAC system based on data indicative of the component and of the additional component; and determine an overall RUL indication for the HVAC system based on the RUL indication for the component and the fault mechanism interactions between the component and the additional component.

9. The non-transitory computer readable storage medium of claim 8, wherein the indication of the parameter is a value of an ambient condition within the HVAC system, adjacent to the HVAC system, or both.

10. The non-transitory computer readable storage medium of claim 9, wherein the ambient condition is an ambient temperature, an ambient humidity, an ambient air quality, an ambient pressure, or any combination thereof.

11. The non-transitory computer readable storage medium of claim 8, wherein the indication of the parameter corresponds to a material characteristic of the component of the HVAC system.

12. The non-transitory computer readable storage medium of claim 8, wherein the instructions, when executed by the processor, cause the processor to:

determine the RUL indication for the component of the HVAC system using the analytical model and the input from the vibration sensor; and output a numerical value for the RUL indication.

13. The non-transitory computer readable storage medium of claim 12, wherein the instructions, when executed by the processor, cause the processor to send the numerical value to a display of the HVAC system, a mobile device, a computing device of a service provider, a computing device of a homeowner, or any combination thereof.

14. The non-transitory computer readable storage medium of claim 8, wherein the instructions, when executed by the processor, cause the processor to determine and output an uncertainty value associated with the RUL indication based on one or more variables.

15. The non-transitory computer readable storage medium of claim 14, wherein the uncertainty value associated with the RUL indication includes a numerical range for the RUL indication.

16. A heating, ventilation, and/or air conditioning (HVAC) system, comprising:

a first vibration sensor coupled to a first component of the HVAC system;

a second vibration sensor coupled to a second component of the HVAC system; and a data analyzer with a processor configured to:

receive a first input from the first vibration sensor coupled to the first component of the HVAC system;

determine a first remaining useful life (RUL) indication for the first component of the HVAC system based on applying a first analytical model using the first input from the first vibration sensor;

receive a second input from the second vibration sensor coupled to the second component of the HVAC system;

determine a second RUL indication for the second component of the HVAC system based on applying a second analytical model using the second input from the second vibration sensor;

determine fault mechanism interactions between the first component and the second component based on data indicative of the first component and of the second component; and determine an overall RUL indication for the HVAC system based on the first RUL indication, the second RUL indication, and the fault mechanism interactions between the first component and the second component.

17. The HVAC system of claim 16, wherein the data analyzer is configured to select, from a library of a plurality of analytical models stored in a memory, the first analytical model based on an indication of a parameter associated with the first component, and wherein the data analyzer is configured to select, from the library of the plurality of analytical models, the second analytical model based on an indication of a parameter associated with the second component.

18. The HVAC system of claim 16, comprising a control system having the data analyzer, wherein the control system is configured to perform a control operation of the HVAC system based on the first RUL indication for the first component, the second RUL indication of the second component, the overall RUL indication of the HVAC system, or any combination thereof.

19. The HVAC system of claim 18, wherein the control operation includes de-rating the HVAC system, shutting down a portion of the HVAC system, or shutting down the HVAC system.

20. The HVAC system of claim 16, wherein the first vibration sensor, the second vibration sensor, or both, include a transducer configured to measure acceleration, displacement, strain, or any combination thereof.

21. The HVAC system of claim 16, wherein the data analyzer is configured to send the overall RUL indication for the HVAC system to a display of the HVAC system, a mobile device, a computing device of a service provider, a computing device of a homeowner, or any combination thereof.

22. The HVAC system of claim 16, wherein the data indicative of the first component and of the second component includes a first type of the first component, a first location of the first component, a first material characteristic of the first component, or any combination thereof, and includes a second type of the second component, a second location of the second component, a second material characteristic of the second component, or any combination thereof.

23. The HVAC system of claim 16, wherein the fault mechanism interactions comprise a first fault mechanism of the first component initiating a second fault mechanism of the second component, accelerating the second fault mechanism of the second component, or both.

* * * * *